US007891130B2

(12) United States Patent
Griffin

(10) Patent No.: US 7,891,130 B2
(45) Date of Patent: Feb. 22, 2011

(54) BARREL LATCH LOCKING DEVICE

(75) Inventor: Todd Griffin, Miami, FL (US)

(73) Assignee: R/M Equipment, Inc., Miami, FL (US)

( * ) Notice: Subject to any disclaimer, the term of this patent is extended or adjusted under 35 U.S.C. 154(b) by 331 days.

(21) Appl. No.: 12/029,974

(22) Filed: Feb. 12, 2008

(65) Prior Publication Data

US 2011/0016765 A1 Jan. 27, 2011

Related U.S. Application Data

(63) Continuation of application No. 10/530,732, filed as application No. PCT/US03/32312 on Oct. 10, 2003, now Pat. No. 7,328,530.

(60) Provisional application No. 60/417,491, filed on Oct. 10, 2002.

(51) Int. Cl.
*F41C 27/06* (2006.01)

(52) U.S. Cl. ..... 42/105

(58) Field of Classification Search ..... 42/1.06, 42/105; 102/483

See application file for complete search history.

(56) References Cited

U.S. PATENT DOCUMENTS 2,981,154 A * 4/1961 Sweeney ..... 89/14.5
3,034,407 A * 5/1962 Darsie ..... 89/14.05
3,507,067 A 4/1970 Into et al.
3,641,691 A * 2/1972 Ellis et al. ..... 42/105
3,967,402 A * 7/1976 Cooksey ..... 42/10
4,689,911 A * 9/1987 White ..... 42/105

FOREIGN PATENT DOCUMENTS

DE 1944625 A1 4/1971

OTHER PUBLICATIONS

Colombian Office Action from Colombian Patent Application No. 05-043929.
Seide, Stephan, Supplementary European Search Report under Art. 153(7) for EPC Appl. No. 03776323.2, Jul. 2, 2010.

* cited by examiner

*Primary Examiner*—Troy Chambers
(74) *Attorney, Agent, or Firm*—Nawrocki, Rooney & Sivertson, P.A.

(57) ABSTRACT

A barrel latch safety for a grenade launcher having a barrel slidable upon a receiver via actuation of a barrel latch is provided. The barrel latch safety includes a locking plate and an elongate member extending from a portion thereof so as to define a crotch between the elongate member and a side edge of said locking plate. The subject safety is adapted to be positioned on the receiver such that a surface adjacent the side edge of the locking plate prohibits barrel latch actuation upon translation of the safety relative to the receiver.

16 Claims, 4 Drawing Sheets

BARREL LATCH LOCKING DEVICE

This is a regular application filed under 35 U.S.C. §111(a) claiming priority under 35 U.S.C. §119(e) (1), of provisional application Ser. No. 60/417,491, having a filing date of Oct. 10, 2002.

This is a continuation of application Ser. No. 10/530,732 filed Feb. 15, 2006 to issue as U.S. Pat. No. 7,328,530 on Feb. 12, 2008 for an invention entitled BARREL LATCH LOCKING DEVICE which is a United States national filing of international patent application PCT/US03/32312 filed Oct. 10, 2003 which claims priority under 35 U.S.C. §119(e)(1) to provisional patent application Ser. No. 60/417,491 filed Oct. 10, 2002.

TECHNICAL FIELD

The present invention generally relates to safety devices for firearms, more particularly, to a barrel latch locking mechanism for a grenade launcher barrel latch.

BACKGROUND OF THE INVENTION

Modular weapon systems are well know, perhaps best exemplified by the tactile or assault weapon wherein a host weapon, most commonly a rifle, is readily modified to receive, among other things, a supplemental device, for instance, a grenade launcher. In the context of multi-functional modular weapon systems incorporating grenade launchers, and typified by a variety of assemblies and subassemblies, safe, reliable weapon operation is especially paramount.

An exemplary launcher for discussion is the Colt® M203 grenade launcher, a lightweight, single-shot, breech-loaded 40 mm weapon designed especially for attachment to the M4 carbine and the M16A2/A4 rifle. It creates a versatile combination weapon system capable of single round firing both 5.56 mm rifle ammunition as well as the complete range of 40 mm high explosive and special purpose ammunition. This launcher, as well as other commercially available launchers, is readily adapted, for instance via use of a variety of known rail attachment systems and the like, for receipt by various host weapons, e.g., submachine gun, shotgun or folding-stock pistol frame as a mounting platform, in addition to the M4 and M16A2/A4.

Launchers generally include a barrel, a receiver, a modified hand guard, a site (e.g., a leaf or quadrant site), and a rail, interbar or pistol frame. A complete self-cocking firing mechanism, including a barrel latch, a trigger and positive safety lever, is integral to the receiver, allowing the launcher to be operated, not only as a supplemental device, but as a completely independent weapon.

As may be readily appreciated, the barrel latch of the launcher is optimally positioned upon the receiver so as to be within ready reach when gripping the launcher barrel about the handguard (i.e., while supporting the launcher, or entire weapon system as the case may be, as by cradling same with the familiar palm-up hand cupping posture). Upon actuation of the barrel latch, the barrel is free to slide forward upon the receiver so as to accept a round of ammunition, or discharge a casing, and thereafter return to a closed, auto-locking position, ready to fire.

Heretofore, common inadvertent (i.e., unintended) manipulation of the barrel latch of the barrel latch mechanism would disengage the barrel from the remaining portion of the subassembly. Launchers have been known to be retrofitted with a barrel latch guard, more particularly, a shield type obstructing structure which minimizes the potential of barrel disengagement via inadvertent hand placement on, about, or across said barrel latch. Although arguably an improvement, the reliability of such shield has proved less than desirable, being, among other things, cumbersome to manipulate in furtherance of loading a round, and/or ejecting a casing. Thus, there remains a need for a barrel latch safety which is of subtle, reliable design, and is advantageously capable of being easily retrofitted to existing grenade launchers.

SUMMARY OF THE INVENTION

A barrel latch locking device for a grenade launcher barrel latch is provided. The locking device includes a body having opposing end portions, a first opposing end portion of the body including a locking plate. The locking device is adapted to be secured to a grenade launcher receiver proximal to the grenade launcher barrel latch for translation with respect thereto. The arrangement is such that a portion of the locking plate intercepts a travel path for the grenade launcher barrel latch, thereby preventing disengagement of a grenade launcher barrel from the grenade launcher receiver via unintentional actuation of the grenade launcher barrel latch.

More specific features and advantages obtained in view of those features will become apparent with reference to the drawing figures and DETAILED DESCRIPTION OF THE INVENTION.

DETAILED DESCRIPTION OF THE INVENTION

Figure 1:
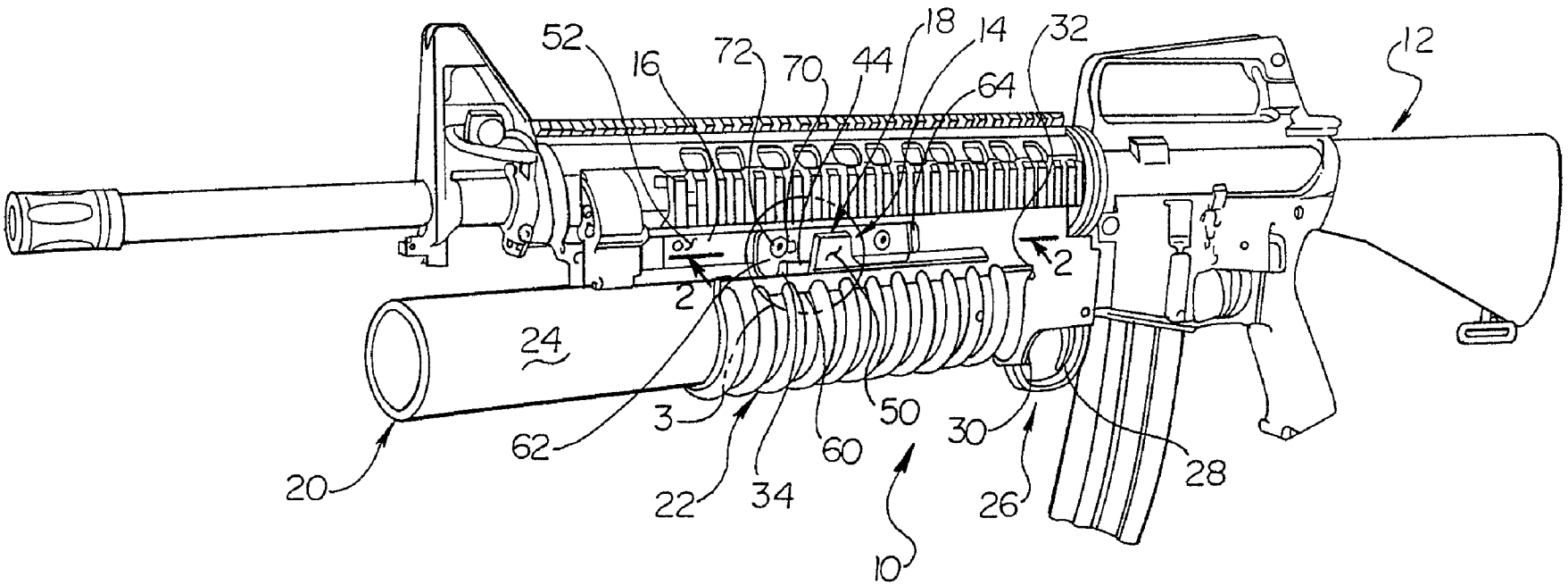
FIG. 1 generally illustrates a weapon system, namely an M16 rifle equipped with a grenade launcher, the barrel latch locking device of the subject invention affixed to a receiver of the launcher and in operative engagement with the barrel latch thereof (i.e., "lock-on")

With general reference to FIG. 1, there is shown a Colt®M203 grenade launcher 10, operatively integrated with an M16 rifle 12, equipped with the barrel latch locking device 14 of the subject invention. The barrel latch locking device 14 is shown affixed to a receiver 16 of the launcher 10, and in operative engagement with a barrel latch 18 thereof (i.e., a "lock-on" condition). It is to be understood that the barrel latch locking device of the subject invention is not limited to operative engagement with the launcher of FIG. 1.

As shown, the grenade launcher 10 generally includes a barrel 20 supported, suspended, or otherwise engaged with the receiver 16 thereof. A handguard 22 substantially extends about a portion of the exterior surface 24 of the barrel 20. The launcher 10, more particularly the receiver 16, further includes, a firing mechanism 26 comprising the barrel latch 18, trigger 28, and trigger safety 30. As is well known, the barrel 20 of the launcher 10 is disengagable from the receiver 16, more particularly a breech end 32 thereof, for translation with respect thereto, in furtherance of loading a munition, and/or discharging a casing of a munition.

The subject barrel latch locking device 14 is adapted to be secured to the launcher receiver 16 proximal to the launcher barrel latch 18, for translation with respect thereto, such that a latch receiving surface 34 thereof selectively intercepts a travel path for the launcher barrel latch 18, thereby preventing disengagement of the launcher barrel 20 from the launcher receiver 16 via unintended actuation of the launcher barrel latch 18. Prior to a detailed discussion of the structure, features and functionality of the subject barrel latch locking device, a discussion of the barrel latch structure and functionality is warranted.

Figure 4:
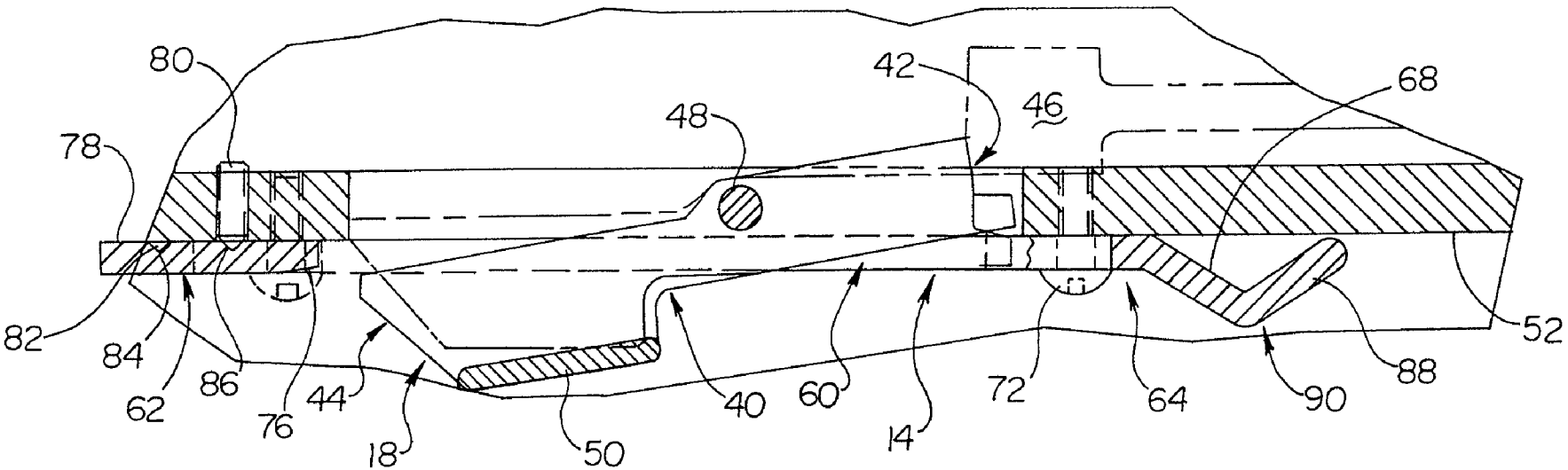

With reference to FIG. 4, the barrel latch 18 of the grenade launcher 10 generally comprises an elongate member (e.g., a bar) 40 having a latch or latching surface 42 opposite a free end 44 thereof, the latch surface 42 intended to selectively engage a portion (e.g., a stop) 46 of the launcher barrel 20, as shown. The barrel latch 18 is pivotably secured by a shaft or pin 48, between its ends, to the launcher receiver 16 such that a portion of the free end 44 (i.e., an actuation surface 50) outwardly projects from a lateral surface (e.g., a sidewall) 52 of the receiver 16 (i.e., the actuation surface 50 is accessible for manipulation of the latch 18). Pivoting of the barrel latch 18 about a pivot axis of the shaft 48, as by "pushing" the actuation surface 50 of the free end 44 into closer proximity to the sidewall 52 of the launcher receiver 16, frees the latch surface 42 from engagement with the stop 46 of the launcher barrel 20 (note ghost lines indicating a disengaged condition for the barrel latch 18), thereby permitting translation of the barrel 20 relative to the receiver 16.

Figure 2:
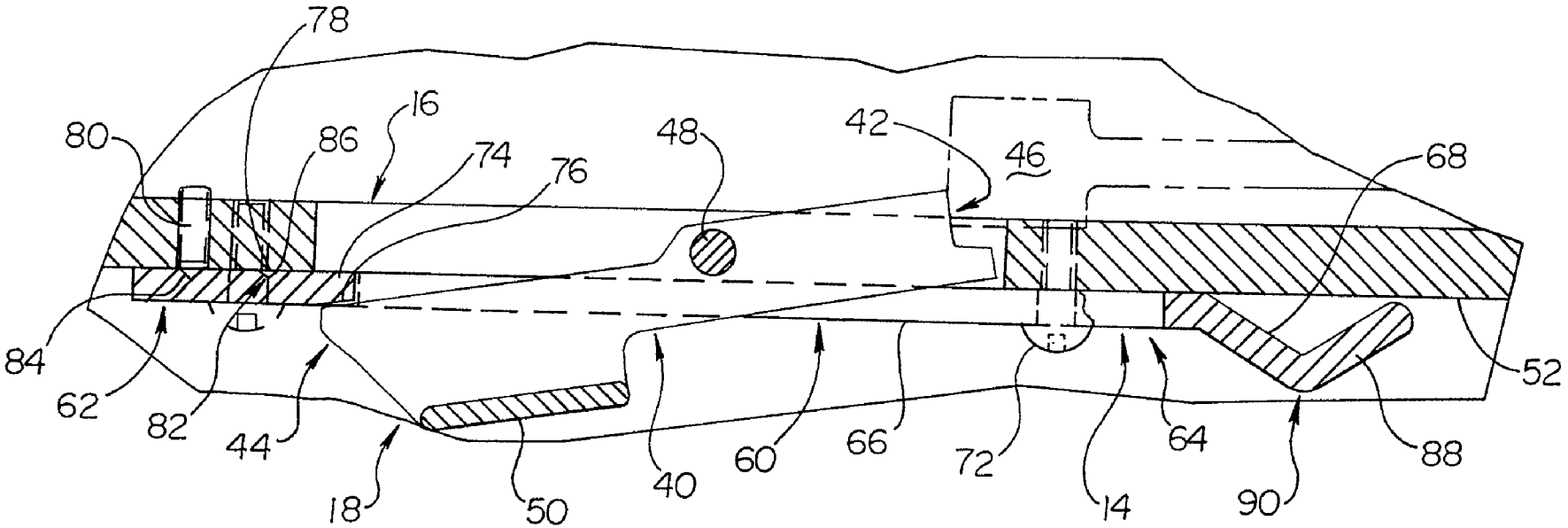
FIG. 2 is a sectional view taken along line 2-2 of FIG. 1 illustrating the interrelationships between components of the subject barrel latch locking device and the barrel latch.
Figure 3:
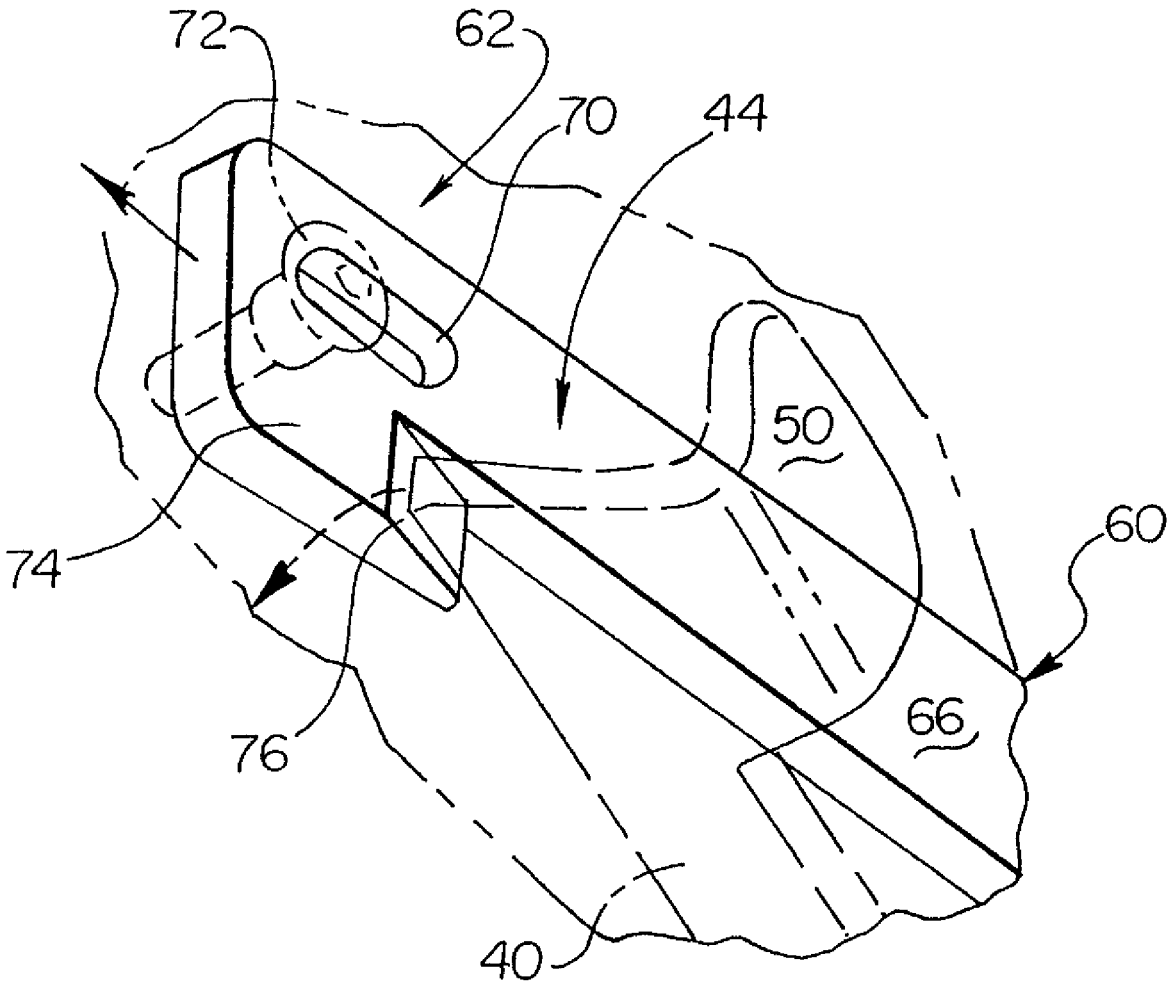
FIG. 3 is a detailed view of the circumscribed area of FIG. 1 illustrating a portion of the barrel latch received upon a latch receiving surface of the subject device; and, FIG. 4 is a view similar to that of FIG. 2, the subject barrel latch locking device disengaged from the barrel latch (i.e., "lock-off").

With general reference now to FIGS. 1-3, the barrel latch locking device generally comprises a body 60 having opposing end portions, more particularly, first 62 and second 64 opposing end portions, for the sake of convention, muzzle and breech end portions respectively, the first opposing end portion 62 of the body 60 being "forward" of the second opposing end portion 64. The device body 60 further, and generally, includes opposing surfaces, namely, first 66 (i.e., visible) and second 68 (i.e., non-visible) surfaces, see e.g., FIG. 2.

Each opposing end portion 62, 64 of the device body 60 preferably includes an aperture or slot 70 to facilitate affixation and retention of the device 14 to the launcher receiver 16, using, as shown, shouldered fasteners 72, or the like. With such arrangement, and based upon the convention adopted herein, the second surface 68 of the device body 60 will be, or is, adjacent the sidewall 52 of the receiver 16, more particularly, an exterior surface of same, see e.g., FIG. 2. The apertures 70 are advantageously configured to permit translation of the locking device 14 upon the fasteners 72, and thereby the receiver 16, namely, between the lock-on (FIG. and lock-off configurations of FIGS. 2 & 4 respectively. One such non-limiting aperture configuration, namely an oval, is shown in FIG. 3, a maximum dimension thereof extending between the opposing end portions 62,64 of the device body 60.

With continued reference to FIGS. 1-3, especially FIG. 3, the first opposing end portion 62 of the device body 60 generally includes a locking plate or blade 74 having a first surface, more particularly, a visible latch receiving surface 76 adapted to operatively engage the free end 44 of the barrel latch 18. A second, non-visible surface 78 of the locking plate 74 (see e.g., FIGS. 2 & 4), opposite the first surface 76, is adapted to seat a detent 80 (e.g., a pin or ball) carried by the sidewall 52 of the receiver 16. More particularly, the non-visible surface 78 of the locking plate 74 includes a pair of spaced apart dimples 82 for receipt and seating of the detent 80 at either a first 84 (FIG. 2) or second 86 (FIG. 4) position of the second surface 78 of the locking plate 74, that is to say, the lock-on and lock-off positions respectively.

The latch receiving surface 76, preferably, but not necessarily, includes a ramped (e.g., beveled) portion so as to provide a sure interference fit for the locking device 14 relative to the barrel latch 18. As will later be detailed, the ramped portion of the latch receiving surface 76 may be effectively wedged between the free end 44 of the barrel latch and the sidewall 52 of the receiver 16 to prohibit actuation of the barrel latch 18.

With reference now especially to FIGS. 1 & 2, the second opposing end portion 64 of the device body 60 preferably, as shown, has a segment configured so as to define a finger rest or grip 88. More generally, the second opposing end portion 64 of the device body 60 is to include a structure to facilitate translation (i.e., actuation) of the device 14 between the lock-on/lock-off conditions of FIGS. 2 & 4 respectively. The subject disclosure is in no way intended to be limiting of the means available to perform the recited function. For instance, the second opposing end portion 64 of the device body 60 may include a protuberance or the like, integral therewith (e.g., a ridge), or attachable thereto (e.g., a knob). Preferably, and advantageously, a terminal end 90 of the second opposing end portion 64 of the device body 60 is configured to include a curve, bend, fold, crease, etc. (i.e., the terminal end 90 is not planar, or alternately stated, a substantial portion of the non-visible surface of the terminal end 90 of the second opposing end portion 64 does not contact the receiver sidewall 52). A not insubstantial amount of force must be imparted to the second opposing end portion 64 of the device body 60 so as to overcome the detent positioning of the device 14 relative to the receiver 16, whether in the lock-on or lock-off position/condition. Thus, a finger rest or hold 88 of large surface area is advantageous, and therefore desirable.

Operation of the subject device is best appreciated by comparison of FIGS. 2 & 4. In the lock-on position of FIG. 2, the latch receiving surface 76 of the locking plate 74 is interposed between a portion of the free end 44 of the elongate member 40 of the barrel latch 18, and the sidewall 52 of the launcher receiver 16, and operatively retained in such condition due to receipt of the receiver detent 80 in the forward most dimple 82 of the non-visible surface 78 of the locking plate 74. Pivot motion of the barrel latch 18, and disengagement of the barrel 20 relative to the receiver 16 thereby, is prohibited.

To attain the lock-off position of FIG. 4 from the lock-on position of FIG. 2, an operator need only apply forward pressure to the finger hold or rest 88 of the second opposing end portion 64 of the device body 60, so as to overcome the bias force of the detent 80 within the forward most dimple 82 of the non-visible surface 78 of the locking plate 74. Upon such manipulation, the subject locking device 14 forwardly slides such that the latch receiving surface 76 of the locking plate 74 is "clear" of the travel path of the free end 44 of the barrel latch 18, the detent 80, seated in the rearward dimple 82, retaining the device body 60 in the lock-off position. By the aforementioned structures, their interrelationship, and their relationship(s) with the launcher components, unintended, inadvertent actuation of the grenade launcher barrel latch is achieved in an efficient, reliable manner.

This invention disclosure provides preferred locking device configurations, and defines preferred relationships and interrelationships between structures of the configuration, in addition to relationships and interrelationships between the subject device and the grenade launcher. There are other variations of this invention which will become obvious to those skilled in the art. It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claim.

What is claimed is:

1. A locking device operably supportable upon a grenade launcher receiver proximal a grenade launcher barrel latch for selective engagement therewith, said device comprising a first end having a locking plate characterized by a first surface engagable with a free end of the grenade launcher barrel latch so as to thereby prevent actuation of the grenade launcher barrel latch and thereby avoid unintended disengagement of the grenade launcher barrel from the grenade launcher receiver, said first surface of said locking plate of said device including a ramped portion.

2. The locking device of claim 1 wherein said surface of said first end includes one or more dimples for receipt of a detent of the grenade launcher receiver.

3. The locking device of claim 2 characterized by a lock-on position wherein said first surface of said locking plate of said device obstructs movement of the free end of the grenade launcher barrel latch.

4. The locking device of claim 3 wherein said lock-on position is further characterized by receipt of the detent of the grenade launcher receiver into a dimple of said one or more dimples of said surface of said first end of the device.

5. A locking device operably supportable upon a grenade launcher receiver proximal a grenade launcher barrel latch for selective engagement therewith, said device comprising a first end having a surface translatable upon a portion of the grenade launcher receiver and a locking plate characterized by a first surface engagable with a free end of the grenade launcher barrel latch so as to thereby prevent actuation of the grenade launcher barrel latch and thereby avoid unintended disengagement of the grenade launcher barrel from the grenade launcher receiver, said first surface of said locking plate of said device including a ramp so as to provide an interference fit with said grenade launcher barrel latch.

6. A locking device for mating with a grenade launcher barrel latch, said locking device comprising:

first and second opposing ends wherein said first opposing end comprises first and second surfaces and a locking plate for connection with a grenade launcher receiver proximal the grenade launcher barrel latch, said second surface of said first opposing end, translatable upon a portion of the grenade launcher receiver, comprises one or more dimples for receipt of a detent within the grenade launcher barrel receiver;

said first surface of said first end engagable with a free end of the grenade launcher barrel latch so as to establish a lock-on position, thereby preventing unintentional disengagement of a grenade launcher barrel from the grenade launcher receiver; and said second opposing end comprising means for engagement of said first end with the free end of the launcher barrel latch.

7. A barrel latch safety for a grenade launcher characterized by a barrel slidable upon a receiver upon disengagement of an interference condition for and between portions of the barrel latch and the receiver, the barrel latch safety comprising a body having opposing first and second end portions, and opposing first and second surfaces, said body supportable upon a surface of the receiver of the grenade launcher, in a vicinity of the barrel latch, such that the barrel latch safety is reversibly translatable between first and second operative arrangements in respect to the barrel latch, said first end portion of said body including a locking plate characterized by a barrel latch receiving surface, said second end portion of said body including an adaptation to facilitate operator translation of the barrel latch safety between said first and second operative arrangements, said first operative arrangement, a "safety-on" condition for the barrel latch safety, characterized by an interference fit for and between said barrel latch receiving surface and a portion of the barrel latch so as to prevent the disengagement of the interference condition for and between portions of the barrel latch and the receiver.

8. The barrel latch safety of claim 7 wherein translation of said body of the barrel latch safety reversibly positions said barrel latch receiving surface of said locking plate in a travel path of a portion of the barrel latch so as to prevent operator actuation of the barrel latch.

9. The barrel latch safety of claim 7 wherein said body includes spaced apart apertures for receipt of spaced apart support hardware carried by the receiver.

10. The barrel latch safety of claim 7 wherein said opposing first and second end portions of said body include slots for receipt of spaced apart support hardware carried by the receiver.

11. The barrel latch safety of claim 7 wherein said first surface of said body is adapted to cooperatively engage a portion of the receiver so as to resist translation in furtherance of retaining one of either of said first or second operative arrangements upon operator translation of the barrel latch safety.

12. The barrel latch safety of claim 7 wherein said first surface of said body includes said barrel latch receiving surface, said second surface of said body, in a vicinity of a portion of said body comprising said barrel latch receiving structure, being adapted to cooperatively engage a portion of the receiver so as to resist translation in furtherance of retaining one of either of said first or second operative arrangements upon operator translation of the barrel latch safety.

13. The barrel latch safety of claim 7 wherein said first surface of said body includes spaced apart dimples for cooperative engagement with the receiver in furtherance of retaining one of either of said first or second operative arrangements via operator translation of the barrel latch safety.

14. The barrel latch safety of claim 7 wherein said second end portion of said body includes a grip to facilitate operator translation of the barrel latch safety.

15. The barrel latch safety of claim 7 wherein said second end portion of said body is formed so as to include an integral finger rest to facilitate operator translation of the barrel latch safety.

16. The barrel latch safety of claim 7 wherein said barrel latch receiving surface of said locking plate includes a ramped portion so as to provide an interference fit for the barrel latch safety relative to the barrel latch.

* * * * *